United States Patent [19]

Gelfand et al.

[11] 4,308,494

[45] Dec. 29, 1981

[54] THYRISTOR POWER CONTROLLER FOR AN ELECTROSTATIC PRECIPITATOR

[75] Inventors: Peter C. Gelfand, Lebanon; Clifford A. Mason, Hummelstown; Jerry F. Shoup, Palmyra, all of Pa.

[73] Assignee: General Electric Co., Lebanon, Pa.

[21] Appl. No.: 50,282

[22] Filed: Jun. 20, 1979

Related U.S. Application Data

[63] Continuation of Ser. No. 847,358, Oct. 31, 1977, abandoned.

[51] Int. Cl.[3] ..... B03C 3/68

[52] U.S. Cl. ..... 323/242; 55/105; 323/244; 323/902; 323/903

[58] Field of Search ..... 55/105, 139; 307/252 T; 323/242, 243, 244, 326, 902, 903

[56] References Cited

U.S. PATENT DOCUMENTS

| | | | |
|---|---|---|---|
| 3,507,096 | 4/1970 | Hall et al. | 55/105 |
| 3,532,855 | 10/1970 | Cleave | 323/24 |
| 3,601,674 | 8/1971 | Joslyn et al. | 323/24 |
| 3,696,288 | 10/1972 | Carman | 323/21 |
| 3,746,970 | 7/1973 | Cleave | 323/22 SC |
| 3,793,557 | 2/1974 | Cramer | 307/252 T |
| 3,873,282 | 3/1975 | Finch | 323/22 SC |
| 4,041,267 | 8/1977 | Wechsler | 323/24 |
| 4,238,723 | 12/1980 | Jenks | 323/902 X |

OTHER PUBLICATIONS

Electronics, Mar. 4, 1976, pp. 112–114.

*Primary Examiner*—A. D. Pellinen

*Attorney, Agent, or Firm*—Robert E. Krebs; Philip L. Schlamp

[57] ABSTRACT

A thyristor power controller for rapidly varying the current delivered to a load and including: a clock circuit for developing a clock pulse for each zero crossing of an AC source, an analog phase circuit responsive to an adjustment current and operative to produce a firing signal for each clock pulse, a first thyristor acting on a positive half cycle of an AC source, a second thyristor acting on a negative half cycle of an AC source, a first thyristor control circuit enabling and disabling the first thyristor, a second thyristor control circuit enabling and disabling the second thyristor, and a thyristor selector operative to route the firing signal to the first or second control circuit.

3 Claims, 10 Drawing Figures

THYRISTOR POWER CONTROLLER FOR AN ELECTROSTATIC PRECIPITATOR

This is a continuation of application Ser. No. 847,358, filed Oct. 31, 1977, now abandoned.

BACKGROUND OF THE INVENTION

1. Field of the Invention

This invention relates generally to thyristor firing devices and more particularly to thyristor power controller systems with an adjustable firing angle.

2. Description of the Prior Art

For many power applications, it is desirable to be able to vary the current delivered to a load. For this purpose, a solid state switching device, such as a thyristor, is often used.

Commonly, two thyristors are used, each switching on alternate half cycles of an AC current. Power control is accomplished by turning on, or triggering, the thyristors at various times during their half cycle of operation. More power is delivered to a load when a thyristor is triggered early in a half cycle and less is delivered if it is triggered late in a half cycle. The time between the beginning of a particular half cycle and a triggering signal to a thyristor acting on that half cycle is known as the phase, or firing, angle and may be measured in degrees. A firing angle of zero degrees would supply the full current of a half cycle to a load, while a firing angle of 180° would supply no current to a load.

Power controller circuits as described above are well known in the prior art and are exemplified by U.S. Pat. Nos. 3,507,096; 3,577,708; 3,648,437 and 3,745,749.

As an illustrative example, U.S. Pat. No. 3,577,708 teaches a power controller with a magnetic amplifier design including an inductor, a transformer and a thyristor network which varies the firing angle of the thyristors to control the current delivered to a load, which in this case is an electrostatic precipitator.

Thyristor power controllers are capable of efficiently varying the current delivered to devices with very high power ratings, such as electrostatic precipitators. A problem with thyristor controllers in the prior art is that the low power timing and firing angle circuits are affected by transients created by the high power, thyristor firing, circuits.

A problem with using magnetic amplifiers to accomplish phase control is that they usually require a few periods to effect a change in the firing angle. Such slow response time creates problems in some power applications, as in the case of electrostatic precipitators, which require virtually immediate response time in order to suppress sparking and/or arcing. Special costly circuits are often necessary to overcome the slow response time of magnetic amplifier circuits.

A further disadvantage with using magnetic amplifiers for phase control is that the firing angle, and consequently the current controlled by the thyristors, is necessarily a nonlinear function of the control signal. Obviously, this introduces difficulties in calibration and operation.

Yet another disadvantage of magnetic amplifiers is that they produce a distorted sine wave at full current rating. This may be undesirable for some applications where harmonics and transient signals must be kept to a minimum.

SUMMARY OF THE INVENTION

It is an object of this invention to provide a thyristor power controller where the low power timing and firing signal circuits are isolated against high power circuit interference.

It is another object of the invention to provide a thyristor power controller with an adjustable firing angle that uses no magnetic control circuits.

It is a further object of this invention to provide a thyristor power controller having a fast response time where the time required to change the firing angle is very small compared to the period of the current under control.

Another object of this invention is to provide a thyristor power controller for which the firing angle may be a linear function of the control signal.

Yet another object of this invention is to provide a thyristor power controller which permits the maximum current delivered to a load to be an undistorted sine wave.

The above objects have been realized with a thyristor power controller including: a clock circuit developing a pulse for each zero crossing of an AC power source, an analog phase circuit responsive to an adjustment current and operative to produce a firing signal for each clock pulse, a first thyristor acting on the positive half cycle of an AC source, a second thyristor acting on the negative half cycle of the AC source, a first thyristor control circuit for enabling and disabling the first thyristor, a second thyristor control circuit for enabling and disabling the second thyristor, and a thyristor selector for routing the firing signal to the first or second thyristor control circuit. The first and second high power thyristor control circuits are shielded from each other and from the low powered circuits. The thyristor selector carries the firing signal to the control circuits through optical fibers.

The optical isolation and circuit shielding are responsible for creating a thyristor power controller for which the low power timing and firing signal circuits are isolated against transient interference produced by the high powered thyristor switching circuits.

The nonmagnetic design of our firing angle circuits allows the maximum current delivered to a load to be an undistorted sine wave.

Our analog phase circuits produce firing angle signals that may be, due to operational amplifier techniques, substantially linear functions of the control signal. Furthermore, the time required to change a firing angle is extremely small compared to the period of the current delivered to a load.

These and other objects and advantages of the present invention will become apparent after reading the following detailed description of the preferred embodiment which is illustrated in the drawing.

IN THE DRAWING

Figures 1, 9:
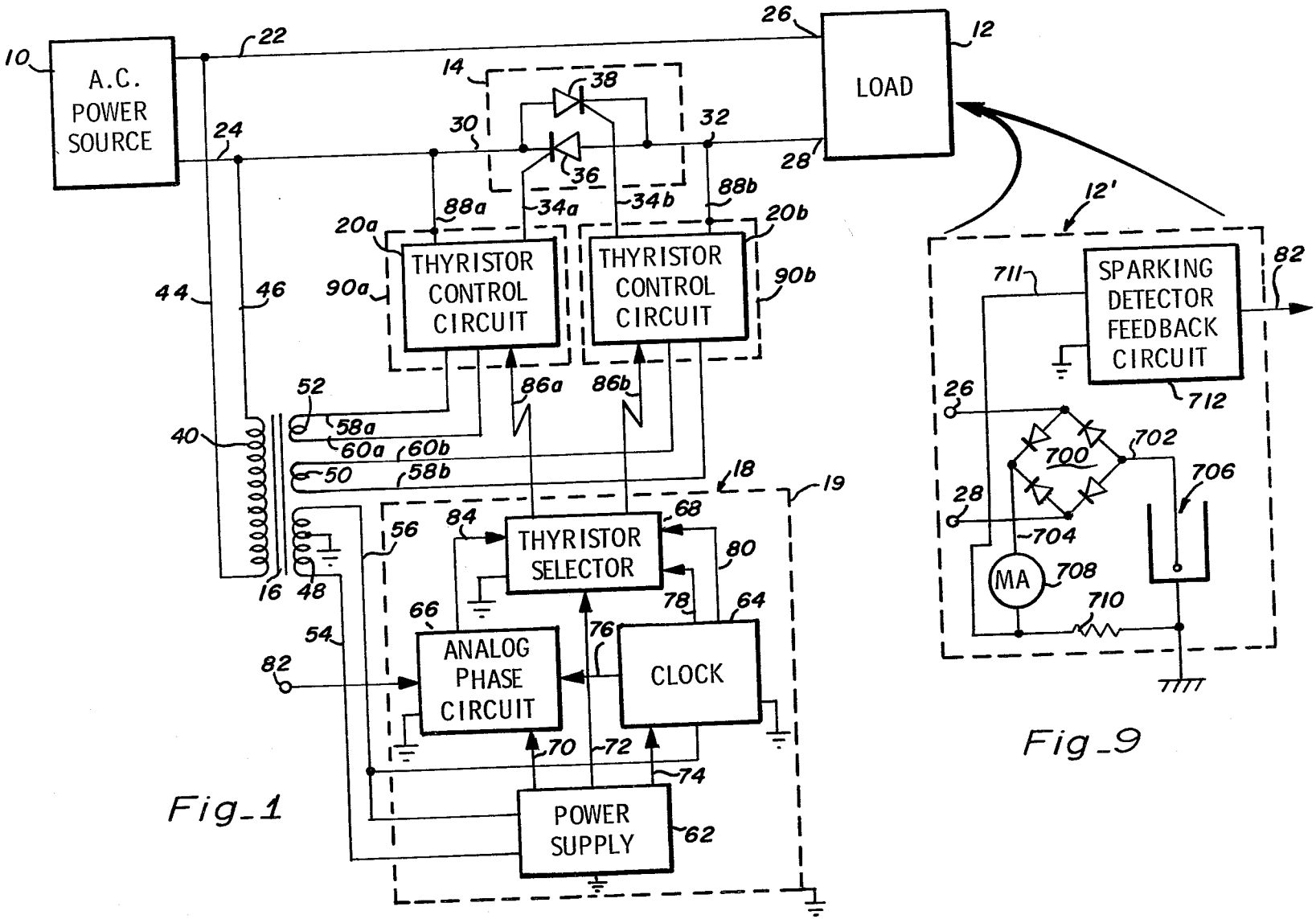
FIG. 1 is a block and schematic diagram of a thyristor power controller in accordance with the present invention.
Figure 6A:
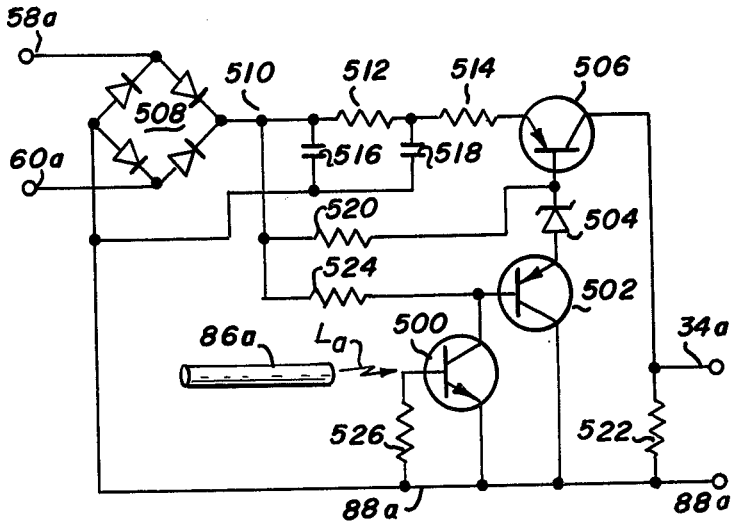
Figure 6B:
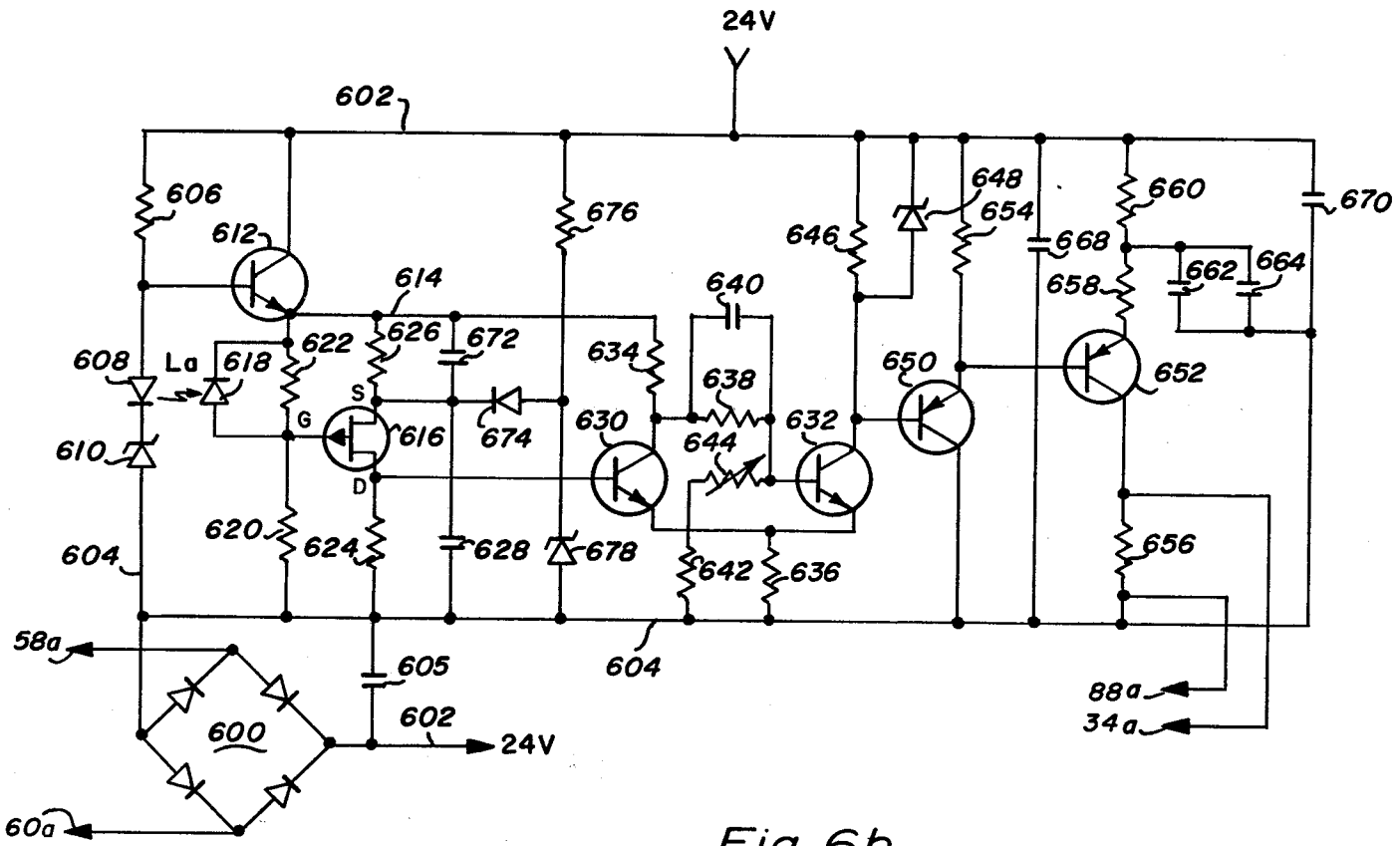
Figure 7:
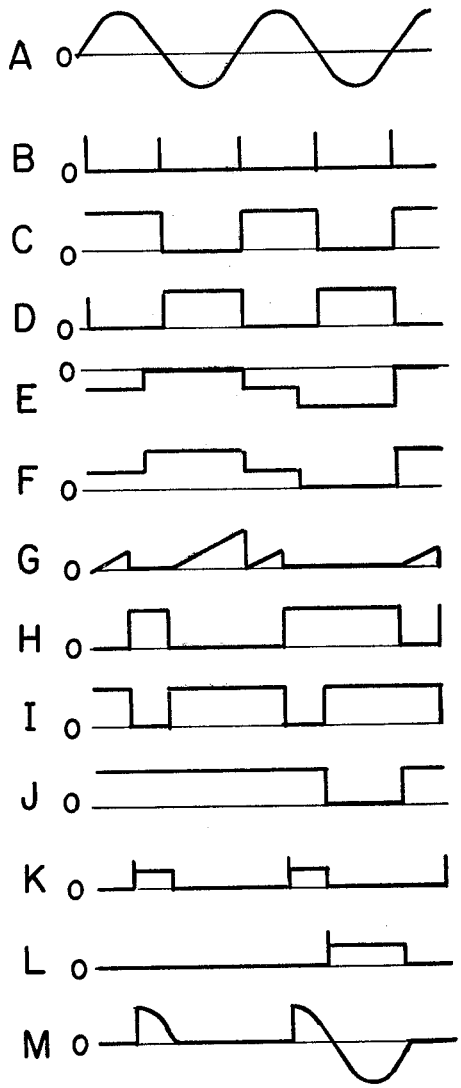
Figure 8:
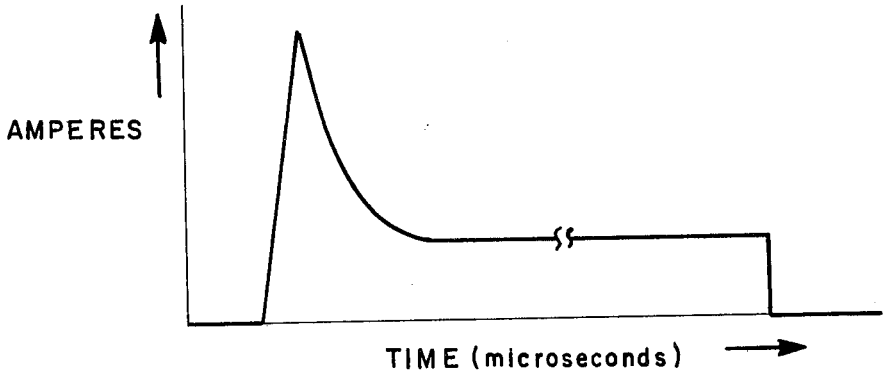

FIG. 6*a* is a schematic diagram further illustrating a design for the thyristor control circuits of FIG. 1;

FIG. 6*b* is a schematic diagram of an alternate embodiment for the thyristor control circuits of FIG. 1;

FIG. 7 is illustrative of waveforms found at various points in the figures;

FIG. 8 further illustrates waveforms K and L of FIG. 8; and

FIG. 9 is a schematic diagram of an electrostatic precipitator circuit used as a load for the thyristor power controller shown in FIG. 1.

DETAILED DESCRIPTION OF THE PREFERRED EMBODIMENT

THYRISTOR POWER CONTROLLER

Referring now to an illustrative embodiment of the present invention with particular reference to FIG. 1, we see peripheral components such as an AC power source 10, a load 12, a thyristor network 14 and a power transformer 16. Low power circuits 18 and high power thyristor control circuits 20*a* and 20*b* are connected, in a manner to be discussed in detail, with the peripheral components to provide a thyristor power controller for rapidly varying current delivered to the load.

AC power source 10 furnishing, for example, 120 volts at 60 Hz supplies lines 22 and 24 with power.

Load 12 has power inputs 26 and 28. Input 26 is connected directly to power line 22.

Thyristor network 14 has power input 30, power output 32, a first gate input 34*a* and second gate input 34*b*. Input 30 is connected to power line 24. Output 32 is connected to power input 28 of the load 12. Thyristor controller 14 of the preferred embodiment is a pair of silicon controlled rectifiers (SCRs) 36 and 38. SCRs 36 and 38 are in parallel, the cathode of SCR 36 being connected to the anode of SCR 38 forming input terminal 30, and the cathode of SCR 38 being connected with the anode of SCR 36, forming output terminal 32.

Power transformer 16 has a primary winding 40 connected to power lines 22 and 24 by wires 44 and 46, respectively. Power transformer 16 further has secondary step-down windings 48, 50 and 52 which supply a reduced voltage to the low and high power circuits. Secondary winding 48 has a grounded center tap and furnishes, for example, 28 volts across lines 54 and 56. Winding 52 develops, in the present embodiment, 18 volts across lines 58*a* and 60*a*. Winding 50 develops the same voltage across lines 58*b* and 60*b*.

Low power circuits 18 include a power supply 62, a clock circuit 64, an analog phase circuit 66, and a thyristor selector 68.

Power supply 62 has power inputs of lines 54 and 56, and power output buses 70, 72, and 74.

Clock circuit 64 has inputs of line 56 and power bus 74, and outputs of lines 76, 78 and 80. Line 76 carries a train of pulses which are always positive with respect to ground. Each pulse in the train corresponds to a zero excursion of the AC current found on line 56. Consequently, for a 60 Hz source, the train of pulses developed on line 76 has a frequency of 120 Hz.

Line 80 carries a square wave having an amplitude which varies between a positive voltage and zero. The square wave on line 80 is positive when the AC current on line 56 is positive and is at zero volts when the AC current on line 56 is negative.

Line 78 carries an inverse square wave that is the inverse of the square wave on line 80. Accordingly, the square wave on line 78 is positive when the AC current on line 56 is negative and zero when the current is positive.

In summary, the outputs of clock 64 are a train of pulses which indicate the beginning of each half cycle of an AC source, and a square wave and an inverse square wave which may be used to determine the polarity of the current half cycle.

Analog phase circuit 66 has inputs of power bus 70, pulse line 76 and adjustment current line 82, and an output of line 84. Circuit 66 determines the firing angle of the thyristors by developing a firing signal on line 84 which is delayed a determined number of degrees after each pulse input on line 76, where the delay is, in the present embodiment, made to be a linear function of the adjustment current input on line 82.

Thyristor selector 68 has inputs of power bus 72, square wave line 80, inverse square wave line 78, and firing signal line 84. Selector 68 has outputs optically transmitted by optical fibers 86*a* and 86*b*.

Selector 68 uses the square and inverse square waves to determine whether the AC power source is in a positive or negative half cycle. The selector then routes the firing signal through either optical fiber 86*a* and 86*b*.

High power thyristor control circuit 20*a* has inputs of lines 58*a*, 60*a* and optical fiber 86*a*. Circuit 20*a* has outputs of lines 34*a* and 88*a*.

When circuit 20*a* detects a firing signal on fiber 86*a*, a firing current is developed on line 34*a*. This causes SCR 36, which is active on a negative half cycle, to conduct. Line 88*a*, which is connected to input 30, provides a return path for the current on line 34*a*.

High power thyristor control circuit 20*b* has inputs of lines 58*b*, 60*b* and optical fiber 86*b*. Circuit 20*b* has outputs of lines 34*b* and 88*b*.

Corresponding to the earlier discussion of circuit 20*a*, when circuit 20*b* detects a firing signal on fiber 86*b*, a firing current is developed on line 34*b*. This causes SCR 38, which is active on a positive half cycle, to conduct. Line 88*b*, which is connected to output 32, provides a return path for the current on line 34*b*.

Optical fibers 86*a* and 86*b* help minimize transient interference between the high power thyristor control circuits 20*a* and 20*b* and low power circuits 18 by reducing their mutual capacitance to a very low level.

Conductive shields 19, and 90*a* and 90*b* are provided around the low power circuits 18 and the thyristor control circuits 20*a* and 20*b*, respectively, to further minimize interference.

In use and operation, an adjustment current is input into the analog phase circuit 66. The phase circuit 66 outputs a firing signal whose firing angle is, in the present emodiment, made to be a linear function of the adjustment current. The thyristor selector 68 routes the firing signal through one or other of the optical fibers 86*a* and 86*b* to one of the two thyristor control circuits 20*a* and 20*b*. The thyristor control circuits enable and disable thyristors active on alternate half cycles of the AC source 10, contingent on the firing signal.

The preceding being a descriptive overview of a thyristor power controller of the present invention, we will now discuss individual circuits of the controller in greater detail.

POWER SUPPLY

Figure 2:
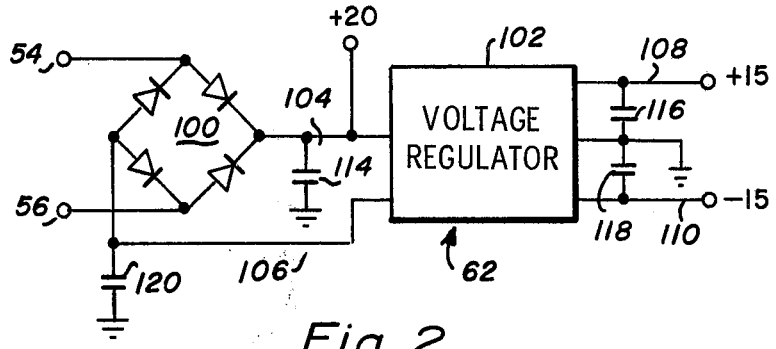
FIG. 2 is a block and schematic diagram further illustrating a power supply as shown in FIG. 1.

Referring now to FIG. 2, the power supply 62 is illustrated in greater detail. The supply 62 includes a bridge rectifier 100 and a voltage regulator 102. Rectifier 100 has power inputs of lines 54 and 56 and develops a DC potential between lines 104 and 106 of approximately +40 volts.

Voltage regulator 102 has power inputs connected to lines 104 and 106, and power outputs connected to lines 108 and 110. Outputs of +15 volts and −15 volts are developed on lines 108 and 110, respectively.

Filter capacitors 114, 116, and 118 and 120 are provided for further smoothing the output of the power supply. Bus lines 70, 72 and 74, illustrated in FIG. 1, include one or more of power lines 104, 108 and 110.

It should be understood in the following description and figures that the several +20, +15 and −15 voltage points are connected to lines 104, 108 and 110, respectively.

CLOCK CIRCUIT

Figure 3:
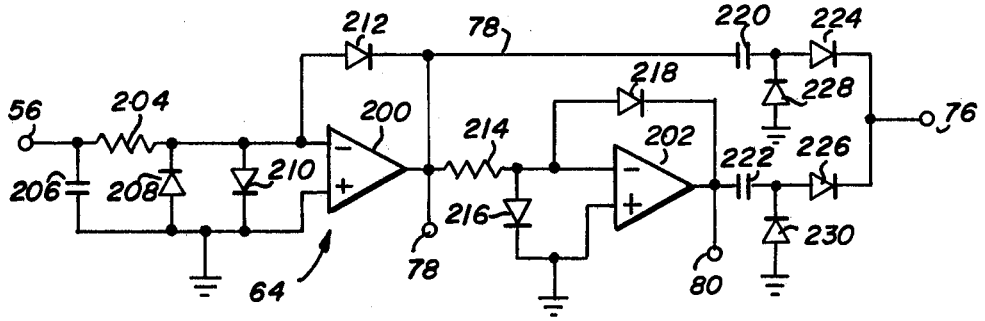
FIG. 3 is a schematic diagram further illustrating a clock circuit as shown in FIG. 1.

Referring now to FIG. 3, the clock circuit 64 is illustrated in greater detail. The circuit 64, includes operational amplifiers 200 and 202 having an inverting (−) and a noninverting (+) input and an output 78 and 80, respectively. The inverting input of operational amplifier 200 is connected to line 56 through a resistor 204. Line 56 is also connected to ground through a capacitor 206 in order to help remove any transients present.

Connected between the inverting input of amplifier 200 and ground are back-to-back diodes 208 and 210. These diodes symmetrically clip the AC voltage to produce a generally square wave with a positive and negative amplitude equal to the voltage drop across the diodes, typically 0.7 volts. The noninverting input of amplifier 200 is grounded.

Operational amplifier 200 again clips the square wave found at its input and produces an output of an inverted square wave on line 78. The inverted square wave on line 78 is prevented from going negative by feedback diode 212, producing a wave that is a positive voltage, typically +15, during negative half cycles and zero volts during positive half cycles.

Operational amplifier 202 acts as a simple inverter of unity gain. The inverting input of amplifier 202 is connected to line 78 through a resistor 214. Connected between the inverting input and ground is a diode 216, which clips the inverted square wave to its voltage drop, again commonly 0.7 volts. The noninverting input of amplifier 202 is grounded.

Operational amplifier 202 inverts the square wave found at its input and produces an output of a square wave on line 80. The square wave on line 80 is prevented from going negative by a feedback diode 218, producing a wave that has a positive potential during positive half cycles and zero volts during negative half cycles.

To provide a train of clock pulses, one for every zero excursion of the AC source, a capacitor 220 differentiates the inverted square wave on line 78 and a capacitor 222 differentiates the square wave on line 80. The output of differentiating capacitor 220 is an alternating positive and negative pulse, corresponding to the zero excursions of the AC source. The output of differentiating capacitor 222 is also an alternating positive and negative pulse, but of opposite polarity with respect to the alternating positive and negative pulse found at the output of capacitor 220. Diodes 224 and 226 act as an OR gate, passing only the positive pulses from capacitors 220 and 222 to line 76. This produces a positive train of pulses on line 76, each pulse corresponding to a zero excursion of the AC source. Diodes 228 and 230 are used to ground out the negative pulses produced by the differentiating capacitors.

ANALOG PHASE CIRCUIT

Figure 4:
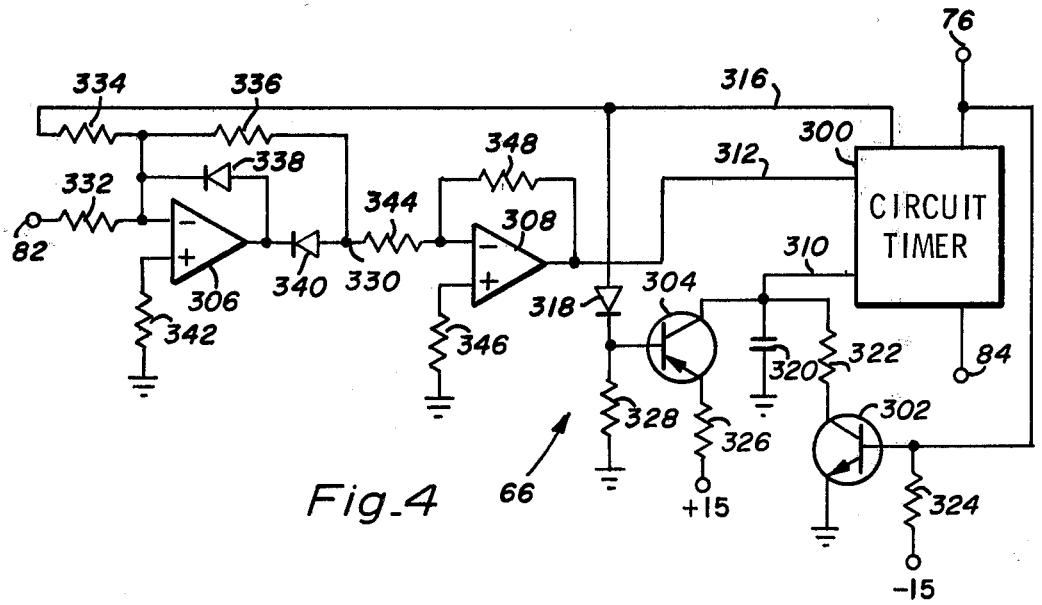
FIG. 4 is a block and schematic diagram further illustrating an analog phase circuit as shown in FIG. 1.

With reference to FIG. 4, it may be seen that the analog phase circuit 66 includes an integrated circuit timer 300; NPN switching transistor 302, PNP constant current transistor 304, and operational amplifiers 306 and 308.

The heart of the analog phase circuit is circuit timer 300, such as the LM 222 made by National Semiconductor. The timer has inputs of line 76 to receive clock pulses, line 310 to receive an R/C voltage, and line 312 to receive an adjustment voltage. The timer develops a firing signal on line 84 whenever R/C voltage on line 310 is equal to or greater than the adjustment voltage. Varying the adjustment voltage, therefore, varies the firing angle of the firing signal. Timer 300 also develops a reference voltage on line 316, which in the case of the LM 222 is equal to 3.15 volts.

The R/C circuit components used to develop an R/C voltage on line 310 include transistors 302 and 304, diode 318, and capacitor 320. At every clock pulse, switching transistor 302 is turned on, completely discharging R/C capacitor 320 through bleeder resistor 322. Biasing resistor 324 is provided to insure that the switching transistor is normally off.

Capacitor 320 is linearly charged through PNP transistor 304, which acts as a constant current source. The anode of diode 318 is connected to reference voltage line 316 and its cathode is connected to the base of transistor 304. Therefore, the base of transistor 304 is held to the reference voltage on line 316 minus the voltage drop across diode 318. Since the emitter voltage of a transistor must equal the voltage supplied at its base plus the emitter/base voltage drop, the emitter voltage of transistor 304 equals the reference voltage, 3.15 volts. In other words, diode 318 and transistor 304 develop voltage drops which cancel, producing the reference voltage at the emitter of the transistor. Furthermore, diode 318 acts to compensate transistor 304 for temperature changes.

The emitter current of transistor 304, which is very nearly the same as the collector current, is therefore held to a constant (15–3.15)/R amperes, where R is the resistance of load resistor 326. A biasing resistor 328 is connected between the base of transistor 304 and ground.

Since capacitor 320 is charging through a constant current source, its waveform will be a linear ramp. Furthermore, since the circuit timer compares this linear ramp to the adjustment voltage to determine the firing angle of the firing signal, the firing angle, with this type of circuit, is made to be a linear function of the adjustment voltage.

The adjustment voltage is developed by operational amplifiers 306 and 308, each having an inverting (−) and a non-inverting (+) input and having outputs on lines 330 and 312 respectively. The inverting input of amplifier 306 is connected to line 82 by a resistor 332. In this preferred embodiment the adjustment current on line 82 is negative in polarity, and therefore develops a negative voltage drop across resistor 332. The inverting input of amplifier 306 is also connected to voltage reference line 316 through resistor 334, adding the voltage drop across resistor 334 to that across resistor 332. Feedback resistor 336 determines the gain of the amplifier. Diodes 338 and 340 prevent the voltage developed on line 330 from going positive. Compensating resistor 342 is connected between the non-inverting input of operational amplifier 306 and ground.

The inverting input of operational amplifier 308 is connected to line 330 by resistor 344. The non-inverting input of amplifier 308 is connected to ground through compensating resistor 346. Amplifier 308 operates as a unity inverter by choosing feedback resistor 348 of the same resistance as resistor 344.

In the present embodiment, the values of resistors 332, 334 and 336 are chosen so that an adjustment current of −5 milliamperes on line 82 develops an adjustment voltage of zero volts on line 312, and zero current produces an adjustment voltage of two volts, where 0–2 volts define the range corresponding to firing angles of 0° to 180°.

Note that the choice of a negative adjustment current is arbitrary. If it were desired to have a positive adjustment current, it would only be necessary to eliminate operational amplifier 308 and reverse diodes 338 and 340. Alternatively, an absolute value circuit could be placed ahead of operational amplifier 306 so that a positive adjustment current would have the same effect as a negative one.

THYRISTOR SELECTOR

Figure 5:
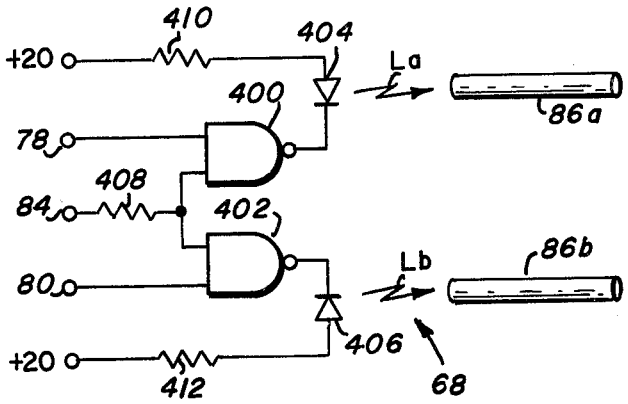
FIG. 5 is a schematic diagram further illustrating a thyristor selector as shown in FIG. 1.

Referring now to FIG. 5, the thyristor selector includes dual input NAND gates 400 and 402, light emitting diodes (LEDs) 404 and 406, and optical fibers 86*a* and 86*b*.

NAND gate 400 has a first input connected to line 78 and a second input connected to line 84 by current limiting resistor 408. The output of the gate is connected to the cathode of LED 404. The anode of LED 404 is connected to +20 volts through resistor 410. Whenever the output of NAND gate 400 is low, i.e., both inputs are high, LED 404 will conduct, producing a light signal $L_a$ which is carried by optical fiber 86*a*.

NAND gate 402 has a first input connected to line 80 and a second input connected to line 84 by resistor 408. The output of gate 402 is connected to the cathode of LED 406. The anode of LED 406 is connected to +20 volts through resistor 412. Whenever the output of NAND gate 402 is low, LED 406 will conduct, producing a light signal $L_b$ which is carried by optical fiber 86*b*.

Since input 78 is an inverse square wave which is of a positive potential on negative half cycles, LED 404 will conduct only when a firing signal is present on line 84 during a negative half cycle.

Analogously, since input 80 is a square wave which is high on positive half cycles, LED 406 conducts only when a firing signal is present on positive half cycles.

Functionally, therefore, the thyristor selector 68 routes the firing signal developed on line 84 to thyristor controller 20*a* on negative half cycles and to thyristor controller 20*b* on positive half cycles of the AC source.

THYRISTOR CONTROL CIRCUITS

The two independent circuits 20*a* and 20*b* are used to control the negative half cycle SCR 36 and the positive half cycle SCR 38, respectively. The two control circuits are identical, and may be understood in greater detail by a study of FIG. 6*a* which illustrates circuit 20*a*.

A thyristor control circuit comprises an optical fiber 86*a*, NPN phototransistor 500, a PNP switching transistor 502, a zener diode 504, a PNP constant current transistor 506 and a bridge circuit 508.

Lines 58*a* and 60*a* are connected to bridge circuit 508 which develops approximately +24 volts across lines 510 and 88*a*. Line 88*a* acts as a floating ground which, for the remainder of this discussion on the control circuits, will be referred to as ground.

The emitter of transistor 506 is connected to line 510 by series resistors 512 and 514. Capacitor 516 is connected between line 510 and ground, and capacitor 518 is connected between the junction of resistors 512 and 514 and ground.

The base of transistor 506 is connected to the cathode of zener diode 504 and to line 510 by biasing resistor 520. The collector of transistor 506 is connected to thyristor firing current line 34*a*, and to ground by resistor 522.

The emitter of transistor 502 is connected to the anode of zener diode 504, which may have a breakdown voltage of approximately 4.3 volts. The collector of transistor 502 is connected to ground. The base of transistor 502 is connected to line 510 by biasing resistor 524.

The collector of phototransistor 500 is connected to the base of transistor 502. The emitter of transistor 500 is grounded. The base of transistor 500 is also connected to ground by biasing resistor 526. Phototransistor 500 is in optically conductive contact with optical fiber 86*a*.

When there is no firing signal in the form of $L_a$ on optical fiber 86*a*, the phototransistor is effectively reverse biased. This allows transistor 502 to become reversed biased by resistor 524. Transistor 506 is reversed biased by resistor 520.

Since transistor 506 is reverse biased, no firing current can flow through resistors 512 and 514 to line 34*a*. Therefore, capacitors 516 and 518 charge to 24 volts, the potential of line 510.

When a firing signal is present on optical fiber 86*a* in the form of $L_a$, phototransistor 500 saturates. This forward biases transistor 502 which, in turn, forward biases transistor 506.

Transistor 506 acts as a constant current source. This is because zener diode 504 holds the emitter voltage of transistor 506 to the sum of the emitter/base voltage drops of transistors 506 and 502 and the breakdown voltage of zener diode 504. In the present embodiment, the emitter voltage is held to 5.7 volts. Therefore, when transistor 506 is forward biased by transistor 502, an initial current of (24–5.7)/R amperes flows through line 34*a*, from capacitor 518, where R is the resistance of resistor 514.

After capacitor 518 is discharged, a constant holding current of (24–5.7)/R amperes flows through line 34*a*, where R is now the combined total resistances of resistors 512 and 514.

As shown by FIG. 8, the thyristor firing current begins with a turn on spike having an amplitude of approximately 0.75 amperes and a rise time of less than one microsecond. The turn on spike is followed by a constant holding current of approximately 0.2 amperes. This follows the manufacturer's recommendation for large SCRs operating with inductive loads.

An alternative embodiment uses a solid state optical coupler combining the functions of an LED and a phototransistor into one package. Thyristor selector 68 and thyristor control circuits 20*a* and 20*b* would then be coupled by a pair of conductors carrying the firing signal, and be isolated by the optical coupler.

Referring now to FIG. 6*b* we see an alternate embodiment for the thyristor control circuit as previously shown and described. If it is deemed advantageous to physically isolate the thyristor selector and other low voltage components from the thyristor control circuits to such an extent where the light signals carried by optical fibers 86*a* and 86*b* have degraded to too low a level to actuate the phototransistor of the previous embodiment, the more sensitive circuit of FIG. 6*b* may be used.

In this more sensitive circuit, lines 58*a* and 58*b* supply AC power to a bridge rectifier 600 which develops a 24 volt DC potential on line 602 with respect to circuit ground line 604, assuming an RMS voltage between lines 58*a* and 58*b* of 18 volts. The voltage developed is filtered and smoothed by a capacitor 605.

A biasing resistor 606 is connected at a first end to line 602 and at a second end to the anode of a diode 608. The cathode of diode 608 is connected to the cathode of a zener diode 610, the anode of zener diode 610 being connected to negative power supply line 604. An NPN transistor 612 has its collector connected to positive power supply line 602, its base connected to the juncture between resistor 606 and diode 608, and its emitter connected to regulated power line 614. Resistor 606 and diode 608 supply current to zener diode 610 to bias it into its operating region. The zener diode, having a breakdown voltage of 20 volts, develops a potential on the base of transistor 612 equal to 20 volts plus one diode drop. The diode drop is cancelled by the emitter base drop to develop a regulated 20 volt potential on line 614. Diode 608 also temperature compensates for transistor 612.

A 'P' channel field effect transistor 616 is provided to amplify the signal developed by light sensitive diode 618. Diode 618 has its cathode connected to line 614 and its anode connected to line 604 by a resistor 620. Attached across the anode and cathode of diode 618 is a resistor 622. The gate of FET 616 is attached to the juncture of diode 618 and biasing resistors 620 and 622. The drain of FET 616 is connected to line 604 by a resistor 624. A biasing resistor 626 connects the source of FET 616 to line 614. Further connected to the transistor's source is decoupling capacitor 628 which is connected at its other end to circuit ground line 604. Resistors 620 and 622 comprise a voltage divider and, since they are typically of the same value, develop 10 volts at the gate of the FET. In this "quiescent" or steady state FET 616 is turned on so that a current flows through resistor 626, the transistor, and resistor 624 to ground, the current being set by the value of resistor 626. In the present embodiment the quiescent or steady state voltage across resistor 624 is typically 5 volts. When a light signal $L_a$ illuminates diode 618, the diode's impedance is caused to decrease, essentially bypassing resistor 622. This would raise the potential of the gate of FET 616 towards 20 volts, thereby shutting off the transistor. Since there is no current through resistor 624, the voltage across that resistor approaches zero. In other words, when there is no light illuminating diode 618 in the quiescent or steady state, there is approximately a 5 volt potential across resistor 624; and when a light does illuminate diode 618, the potential developed across the resistor 624 is zero.

Transistors 630 and 632 form a Schmitt trigger, where the collector of transistor 630 is connected to line 614 by a resistor 634, its base is connected to the drain of transistor 616, and its emitter is connected to line 604 by a common emitter resistor 636. Transistor 632 also has its emitter connected to line 604 by resistor 636, and has its base connected to the collector of transistor 630 by the parallel path provided by a resistor 638 and a speed-up capacitor 640. The base of transistor 632 is further connected to line 604 by the series path provided by a resistor 642 and a trigger level adjustment potentiometer 644. The collector of transistor 632 is connected to line 602 by the parallel path provided by a resistor 646 and a zener diode 648.

When FET 616 is in its quiescent or steady state the input of the Schmitt trigger, which is the base of transistor 630, is at 5 volts, which causes the output of the Schmitt trigger, which is the collector of transistor 632, to develop the voltage on line 602, which, in the present embodiment, is 24 volts. When light impinges upon photosensitive diode 618 and FET 616 is turned off, the input voltage to the Schmitt trigger goes to circuit ground potential, causing transistor 632 to conduct and, due to the 10 volt drop across zener diode 648, to develop 14 volts at its output. In other words, when light illuminates diode 618 the output of the Schmitt trigger is 14 volts, and when no light impinges on transistor 618 the output of the Schmitt trigger is 24 volts. This has the effect of "squaring up" the signal developed by diode 618.

An emitter follower transistor 650 is provided to raise the gain of the output of the Schmitt trigger. The base of transistor 650 is connected to the output of the Schmitt trigger, the collector of the transistor is connected to circuit ground on line 604, and the emitter of the transistor is connected to positive potential line 602 by means of a pull-up resistor 654. The base of a transistor 652 is connected to the emitter of transistor 650, the collector being connected to ground by a resistor 656, and the emitter being connected to line 602 by the series connection of resistors 658 and 660. The juncture of resistor 658 and 660 is connected to ground by way of a pair of parallel capacitors 662 and 664. Capacitors 668 and 670 are decoupling capacitors designed to reduce AC transients between power lines 602 and circuit ground.

When the output of the Schmitt trigger is at 24 volts, i.e., no light is illuminating diode 618, transistors 650 and 652 are biased off. When the output of the Schmitt trigger is at 14 volts, i.e., when light is illuminating diode 618, transistor 650 is forward biased, which in turn forward biases transistor 652. Since the voltage at the base of transistor 650 is held to 14 volts by zener diode 648, the emitter of transistor 652 is held to the voltage at its base plus the voltage drop or, in other words, two diode voltage drops above that of the base of transistor 650, or, in the present embodiment, approximately 15.5 volts. Consequently, transistor 652 acts as a constant current source, after capacitors 662 and 664 discharge, by fixing the emitter resistor voltage to about 8.5 volts. Thus, in the steady state when transistor 652 is on, a current of $8.5/(R1+R2)$, where R1 and R2 are the resistances of resistors 658 and 660, respectively, flows through resistor 656. This steady state current corresponds to the holding current as previously discussed and as shown in FIG. 8. Just after transistor 652 is turned on in response to light signal $L_a$ illuminating diode 618, capacitors 662 and 664 discharge producing the SCR activating spike previously described in the discussion of FIG. 8. In this embodiment, two capacitors are used because one is larger to hold a greater charge and the other improves high frequency characteristics.

A capacitor 672, a diode 674, a resistor 676 and a zener diode 678 prevent accidental firing of the SCR's during system power up and power down. Capacitor 672 is connected across resistor 626, and resistor 676 and zener diode 678 form a series connection between positive and ground power lines 602 and 604, respectively. The anode of diode 674 is connected to the juncture of resistor 676 and zener diode 678, and the cathode of diode 674 is connected to the source side juncture of capacitor 672 and resistor 626. Normally, when power is first applied, FET 616 would be off, inducing the Schmitt trigger to activate transistors 650 and 652, and producing an SCR actuating signal. This is avoided in the present circuit by capacitor 672 which, while charging, reduces the voltage drop across resistor 626 causing current to flow through FET 616 during power-up, disabling the Schmitt trigger, and preventing firing. During power-down as the potential on line 614 drops, capacitor 672 would normally turn on FET 616, firing the SCR. However, in the present circuit, voltage set by zener diode 678, typically 9 volts, is developed at the anode of diode 674. If the voltage on the source drops below 9 minus the voltage drop of diode 674, current will flow through the diode, holding FET 616 on, and preventing the firing of the SCR.

OPERATION

The theory of operation is believed to be as follows

Referring to the Figures and with special reference to FIG. 7, clock 64 inputs AC current from line 56. This is illustrated by waveform 7A. The clock outputs a train of pulses (waveform 7B) on line 76, a square wave (waveform 7C) on line 80 and an inverse square wave (waveform 7D) on line 78.

Analog phase circuit 66 receives the pulses on line 76 and an adjustment current on line 82. An illustrative example of a rapidly fluctuating adjustment current is shown in waveform 7E. Circuit 66 converts the adjustment current to an adjustment voltage, illustrated in waveform 7F. At every clock pulse, R/C capacitor 320 is caused to charge, producing a ramping waveform as shown in FIG. 7G. The R/C capacitor will continue ramping until its voltage, as sensed by circuit timer 300, is equal to or greater than the adjustment voltage. When this happens, timer 300 discharges capacitor 320 and produces a firing signal as in FIG. 7H.

Thyristor selector 68 receives the firing signal on line 84 and the square and inverse waves on lines 80 and 78 respectively. The selector outputs on optical fibers **86*a* and 86*b*. The signals carried by fibers 86*a* and 86*b*** are illustrated by waveforms 7I and 7J, respectively.

Thyristor control circuit **20*a* detects the signal on optical fiber 86*a* and outputs a thyristor firing current on line 34*a***. The waveform of the thyristor firing current may be seen in FIG. 7K.

Thyristor control circuit **20*b* detects the signal on optical fiber 86*b* and outputs a thyristor firing current on line 34*b*. The waveform of the current on line 34*b*** may be seen in FIG. 7L.

SCRs 36 and 38 are switched by the firing currents on lines **34*a* and 34*b*, respectively. The current delivered to load 12** resembles waveform 7M.

TYPICAL APPLICATION FOR THYRISTOR CONTROLLER

FIG. 9 shows, in schematic and block diagram form, an application for the thyristor power controller of the present invention. The load, in this case, is an electrostatic precipitator apparatus 12'. Load input lines 26 and 28 are connected to a bridge rectifier 700 which has a negative output on line 702 and a positive output on line 704. Line 702 is connected to an electrostatic precipitator 706. Milliammeter 708, which measures the current flowing through the precipitator 706 is connected to a first end to line 704 and is connected to the ground of precipitator 706 by a sensing resistor 710. A line 711 connects the juncture of milliammeter 708 and resistor 710 to spark detecting feedback circuit 712 which monitors for sparking and arcing and develops a control signal which is output on line 82 to be fed into the analog phase circuit 66 shown in FIG. 1. Thus, the thyristor power controller has the feature of self-regulation when provided with the proper feedback circuitry.

Although the present invention has been described above with reference to a particular preferred embodiment, it is understood that modifications thereof will be obvious to those skilled in the art. It is therefore intended that the appended claims be interpreted to cover all such modifications as fall within the spirit of the invention.

What is claimed is:

1. A thyristor power controller for controlling power from an AC power source to an electrostatic precipitator, where electrical impedance of the precipitator can vary widely over each half-cycle of applied power, said thyristor power controller comprising:

a clock circuit electrically joined to said power source for producing a train of pulses, each pulse corresponding to a zero excursion of the AC current from said power source, said clock circuit further producing a first square wave that is at a positive electrical potential when said AC current is positive and at zero electrical potential when said AC current is negative, and a second square wave that is the inverse of said first square wave;

an analog phase circuit connected to said clock circuit and to an input terminal, said analog phase circuit being responsive to said pulses and to variations in an adjustment current at said input terminal, said analog phase circuit comprising:

(a) means for converting said adjustment current to a corresponding adjustment voltage;

(b) linear timing means responsive to said pulses and operative to develop a ramp voltage that is a linear function of time, said linear timing means including a constant current source, a timing capacitor connected to said constant current source, and means responsive to said pulses and operative to discharge said capacitor at each pulse; and (c) circuit timer means responsive to said adjustment and ramp voltages, said circuit timer means being operative to produce a firing signal when the ramp voltage is at least equal to the adjustment voltage, the firing angle of the firing signal being variable between 0° and 180° depending upon the value of said adjustment current, whereby the firing signal that is produced after any particular pulse is delayed after said pulse for a time duration determined by said adjustment current;

a first thyristor control circuit operative to produce a first thyristor firing current in response to the firing signal;

a second thyristor control circuit operative to produce a second thyristor firing current in response to the firing signal;

a thyristor selector coupled to the analog phase circuit and to the clock circuit, said thyristor selector being responsive to said first square wave and to said second square wave, said thyristor selector being capable of receiving and routing the firing signal to said first and second thyristor control circuits;

a first thyristor responsive to said first thyristor firing current and operative to switch on a negative half cycle of said AC power source; and a second thyristor responsive to said second thyristor firing current and operative to switch on a positive half cycle of said AC power source.

2. The thyristor power controller of claim 1 wherein said thyristor selector comprises a first input to receive said first square wave, a second input to receive said second square wave, a third input to receive firing signals, a first NAND gate connected to the first and third inputs and a second NAND gate connected to the second and third inputs, the output of the first NAND gate being connected to the cathode of a first LED and the output of the second NAND gate being connected to the cathode of a second LED, the anodes of the first and second LEDs each being connected to a reference potential source, a first optical fiber being coupled to said first LED and a second optical fiber being coupled to said second LED; and wherein said first optical fiber is coupled to said first thyristor control circuit and said second optical fiber is coupled to said second thyristor control circuit.

3. The thyristor power controller of claim 2 wherein said first thyristor control circuit has a first phototransistor optically coupled to said first optical fiber, and said second thyristor control circuit has a second phototransistor optically coupled to said second optical fiber.

* * * * *